United States Patent [19]

Yamada et al.

[11] Patent Number: 5,055,073

[45] Date of Patent: Oct. 8, 1991

[54] PIN SPACER IN A MULTI-PIN CONNECTOR AND METHOD OF FABRICATING SAME

[75] Inventors: Yuuji Yamada, Yokohama; Shinsuke Kunishi, Osaka; Yoshiyuki Mizuno, Sagamihara, all of Japan

[73] Assignee: Molex Incorporated, Lisle, Ill.

[21] Appl. No.: 491,392

[22] Filed: Mar. 8, 1990

[30] Foreign Application Priority Data

Mar. 9, 1989 [JP] Japan ..... 1-27207[U]

[51] Int. Cl.[5] ..... H01R 13/46

[52] U.S. Cl. ..... 439/892; 439/75; 439/149

[58] Field of Search ..... 174/138 G; 29/739, 741; 439/55, 65, 74, 75, 76, 736, 892, 149, 150

[56] References Cited

U.S. PATENT DOCUMENTS

| | | | |
|---|---|---|---|
| 4,394,795 | 7/1983 | Goss | 439/892 X |
| 4,533,188 | 8/1985 | Miniet | 439/892 X |
| 4,655,516 | 4/1987 | Shaffer et al. | 439/67 |
| 4,776,804 | 10/1988 | Johnson et al. | 439/892 X |
| 4,840,573 | 6/1989 | Seidel et al. | 439/92 |
| 4,872,845 | 10/1989 | Korsunsky et al. | 439/70 |
| 4,992,054 | 2/1991 | Cassan | 439/76 |

FOREIGN PATENT DOCUMENTS 2008342 9/1971 Fed. Rep. of Germany .

OTHER PUBLICATIONS

IBM Technical Bulletin, vol. 26, No. 1 Connector Aligner Aid, 6–1983.

*Primary Examiner*—Neil Abrams
*Assistant Examiner*—Khiem Nguyen
*Attorney, Agent, or Firm*—Louis A. Hecht; Stephen Z. Weiss; Charles S. Cohen

[57] ABSTRACT

An improved anti-bend pin spacer is disclosed for use in a multi-pin connector which includes a male plug having pins terminals fixed in its housing, and a female receptacle having pin holes and contact terminals fixed in its housing. The pin spacer is an insert molded part which is insert molded about free ends of the pin terminals simultaneously with the insert molding of substantial lengths of the pin terminals in the housing of the male plug.

9 Claims, 3 Drawing Sheets

FIG.1
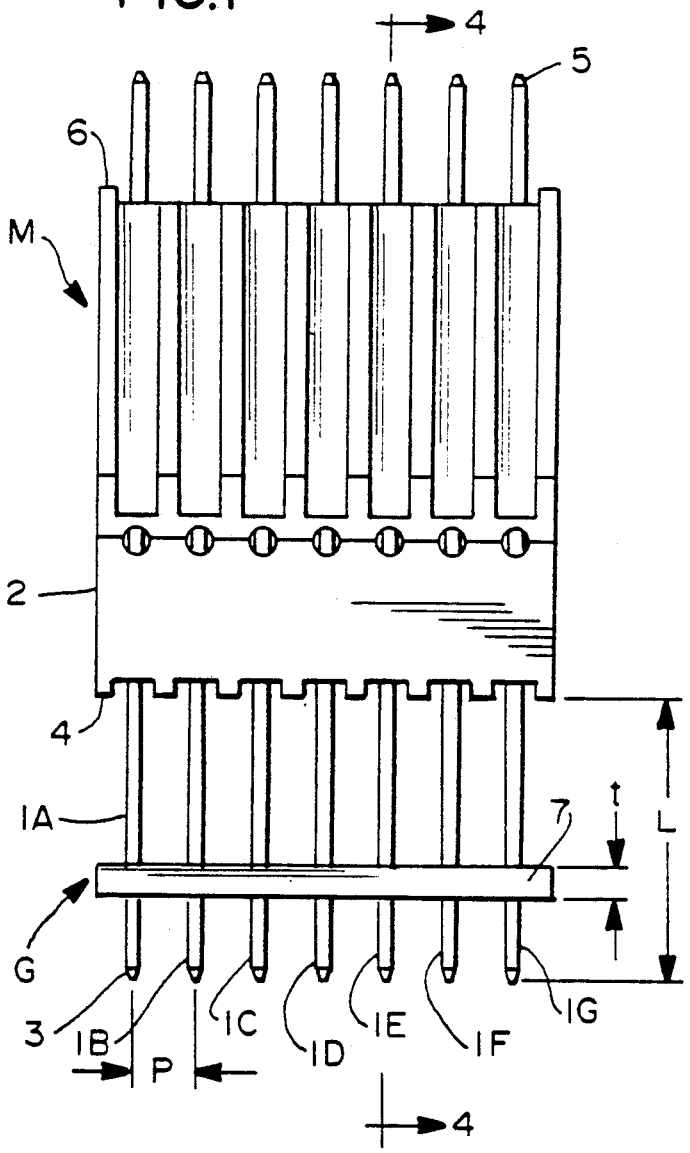
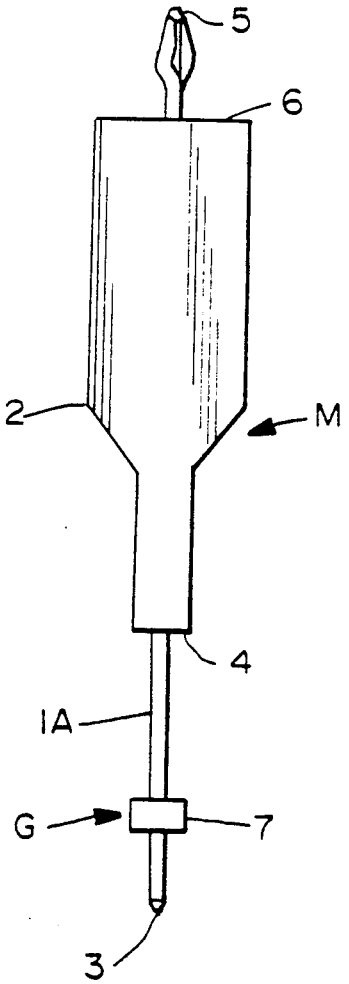
FIG.3
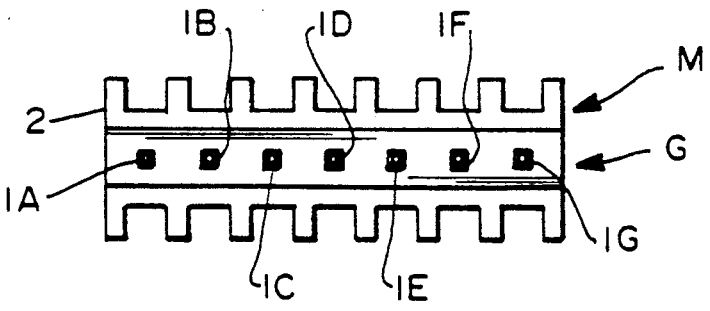
FIG.2

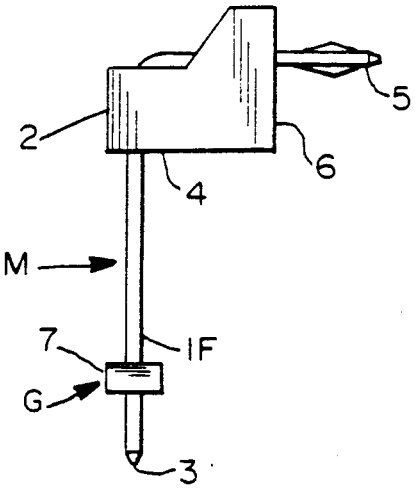
FIG.8
FIG.9
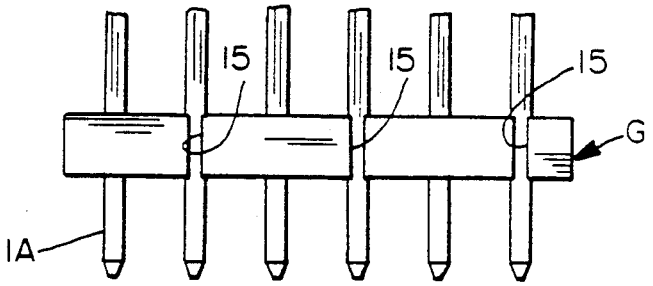
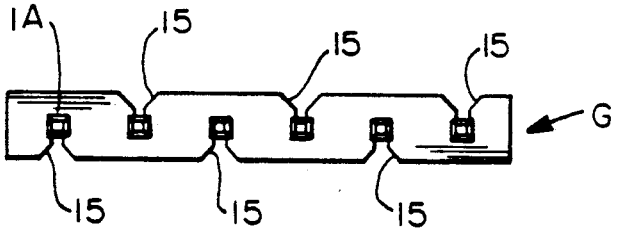
FIG.10
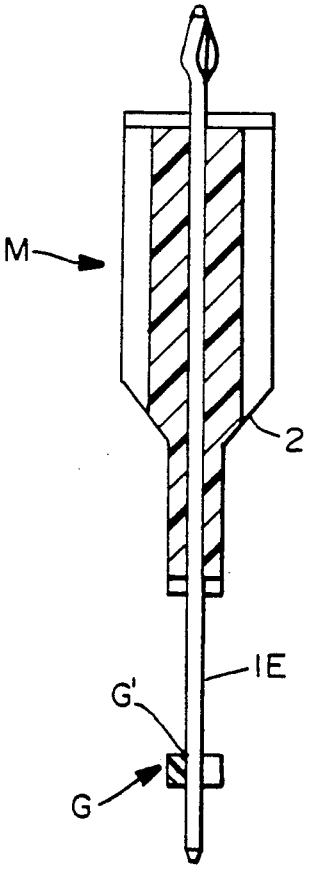
FIG.11

PIN SPACER IN A MULTI-PIN CONNECTOR AND METHOD OF FABRICATING SAME

FIELD OF THE INVENTION

This invention relates to a pin spacer which is slidably mounted to the pin terminals of a male plug in a multi-pin connector, thereby preventing undesired bending of the pin terminals prior to mating with a female receptacle.

BACKGROUND OF THE INVENTION

Multi-pin connectors, each comprising a male plug and a female receptacle, are widely used to establish contacts between selected conductors of different printed circuits.

In manufacturing a multi-pin connector, a housing first is formed by molding, and pin terminals are inserted into the molded housing by pressure. In shipping or warehousing multi-pin connectors, however, they are liable to be subjected to undesired external forces prior to being used, with the result that some of the pin terminals can become bent, thus causing irregular spacings between the pin terminals and preventing the male and female parts from mating together.

In an attempt to prevent such undesirable bending, a pin spacer having the same number of holes as the number of pin terminals of a male plug, and at the same pitch as the pin terminals, has been proposed. This pin spacer is attached to the pin terminals of the male plug by insertion of the pin terminals into the holes of the pin spacer.

When the pin terminals of the male plug are inserted into the pin holes of a female receptacle, the pin spacer will be driven backwards by the female receptacle until it has been pushed against the front face or end of the housing of the male plug, whereby the pin spacer will be sandwiched between the male and female parts.

This type of pin spacer has been long used and has been found to be satisfactory. However, such pin spacers still have the following defects:

1) Manufacturing and storage of multi-pin connectors with such pin spacers are difficult and manufacturing costs are high. This is because a relatively complicated mold must be used to make perforated pin spacers, the pin spacers must be assembled with male plugs by insertion of the pin terminals of the plugs into the pin holes of the pin spacers, and a jig must be used to put a pin spacer on the pin terminals of each plug at a desired position;

2) Automatization of the manufacturing of plug-and-pin spacer assemblies is very difficult; and 3) Certain terminal pins of a plug have different resistances against insertion into corresponding pin holes of the pin spacer. This is, for instance, attributable to irregular sizes of the pin holes of the pin spacer or attributable to bending of some of the pin terminals. As a result, some pin terminals fail to fit the inner circumferences of the pre-formed holes of the pin spacer, and, consequently, the pin spacer is somewhat slanted when mounted to the plug. When this happens, subsequent insertion of the terminal pins of the plug into the pin holes of the receptacle will cause the pin spacer to move at an inclined posture towards the front wall of the plug, preventing complete fitting of the male plug and female receptacle.

SUMMARY OF THE INVENTION

An object, therefore, of the invention is to provide an anti-bend pin spacer which can be produced at a reduced cost by eliminating the use of complicated molds and by reducing the number of manufacturing steps.

Another object of the invention is to provide an anti-bend pin spacer which facilitates automated manufacture of such devices.

Still another object of the invention is to provide an anti-bend pin spacer which assures that each pin terminal of the plug can be correctly inserted into a corresponding pin hole of the receptacle, and that every pin terminal can be inserted into a corresponding pin hole with equal sliding resistance, thereby facilitating the mating of the male plug and female receptacle.

In order to attain these objects, an anti-bend pin spacer is contemplated by the invention wherein a multi-pin connector includes a male plug having a plurality of pin terminals fixed in its housing, and a female receptacle having a plurality of pin holes for accommodating the pin terminals with a plurality of contact terminals fixed in its housing. The contact terminals are adapted to establish contact with the pin terminals of the male plug by insertion into the pin holes of the female receptacle. The invention contemplates that the pin spacer be formed by pouring a molten dielectric material into a relatively simple mold to embed the pin terminals in the vicinity of their free ends in the molten dielectric material at the same time as forming the plug housing by pouring a molten dielectric material into a mold to embed substantial lengths of the pin terminals therein.

In use, first the free ends of the pin terminals of the male plug are inserted into the pin holes of the female receptacle until the front wall surface of the receptacle comes into contact with the pin spacer. The receptacle then is pushed towards the plug, pushing the pin spacer towards the plug. Finally, the pin spacer is pushed against the front wall of the plug, resulting in the pin spacer being sandwiched between the plug and the receptacle. As the pin spacer moves on the pin terminals of the plug it keeps a correct posture in which the pin spacer lies perpendicular to the pin terminals of the plug. This is because all pin holes of the pin spacer can fit on all pin terminals of the male plug due to the insert molding, thus providing the same resistance with all pin terminals of the plug when the pin spacer slides along the pin terminals, and without causing the pin spacer to incline as it moves along the pins. Thus, smooth sliding of the pin spacer and correct pitch or inter-pin interval will be assured. When the pin terminals of the plug have been completely inserted into the pin holes of the receptacle, the pin spacer will be sandwiched between the plug and the receptacle.

Prior to being mated and used, the plug has a pin spacer attached to its pin terminals, and, therefore, even if undesired exterior forces should be applied to the pin terminals of the plug while being shipped or warehoused, the pin terminals will be protected against bending. In manufacturing such plugs, no extra complicated molds, such as required for shaping the aforesaid prior perforated pin spacers is required. No assembly work is required, and hence a jig is not required for placing a pin spacer on the pin terminals of the plug at a desired location. Accordingly, the manufacturing cost will be decreased.

Other objects, features and advantages of the invention will be understood from the following detailed description of the preferred embodiments of the present invention, which are shown in accompanying drawings.

BRIEF DESCRIPTION OF THE DRAWINGS

The features of this invention which are believed to be novel are set forth with particularity in the appended claims. The invention, together with its objects and the following description taken in conjunction with the accompanying drawings, in which like reference numerals identify like elements in the figures and in which:

FIG. 1 is a plan view of a male plug having a pin spacer on its pin terminals according to a first embodiment of the present invention;

FIG. 2 is a front elevational view of the male plug and pin spacer assembly of FIG. 1;

FIG. 3 is a side view of the male plug and pin spacer assembly as viewed from the right of the assembly in FIG. 1;

FIG. 8 is a side view of the male plug and pin spacer assembly as viewed from the right of the assembly in FIG. 7.

FIG. 9 is a plan view of the pin spacer of FIG. 1 according to an alternative embodiment;

FIG. 10 is a front elevational view of the pin spacer of FIG. 9; and

FIG. 11 is a section similar to that of FIG. 4 but showing the alternative embodiment of the pin spacer of FIG. 9.

DETAILED DESCRIPTION OF THE PREFERRED EMBODIMENTS

Figure 4:
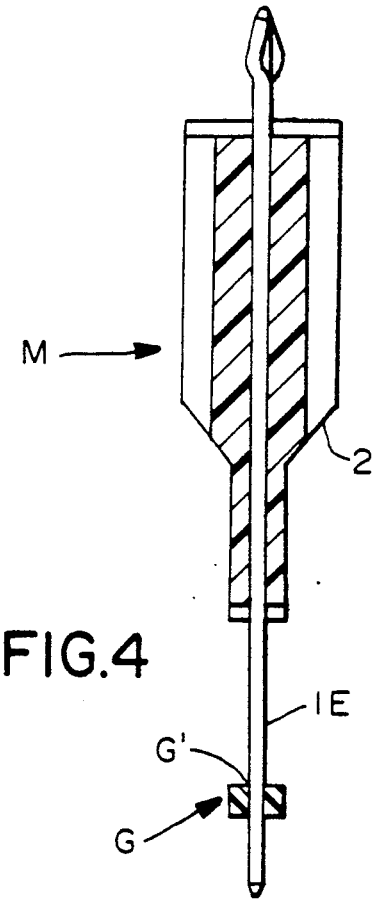
FIG. 4 is a section taken generally along line 4—4 in FIG. 1.
Figure 5:
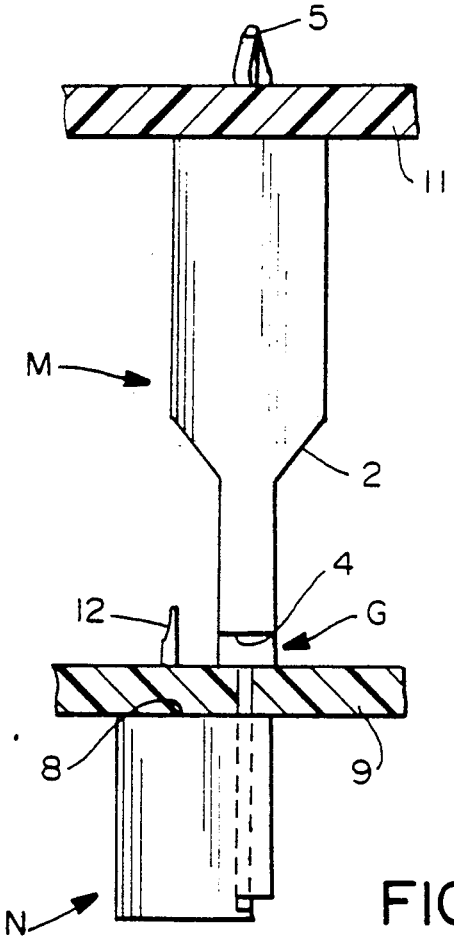
FIG. 5 is a side view, showing the manner in which the male plug and pin spacer assembly is mated with a female receptacle.

FIGS. 1–5 show a male plug M of a multi-pin connector with a pin spacer G on its pin terminals 1A–1G according to a first embodiment of the present invention. As shown in these drawings, pin terminals 1A–1G are arranged side-by-side at regular intervals or pitch P. A housing 2 is shaped by insert molding to confine the pin terminals 1A–1G of the plug, allowing front lengths L and rear lengths 5 of the pin terminals to project from a front wall 4 and rear wall 6, respectively, of housing 2. A female receptacle N of the multi-pin connector is shown in FIG. 5.

Pin spacer G is a molded part which is formed by pouring a molten dielectric material into a relatively simple insert mold to embed pin terminals 1A–1G in the vicinity of their free ends 3 in the molten dielectric material at the time of molding housing 2 by pouring a molten dielectric material into another mold to embed substantial lengths of the pin terminals 1A–1G in the housing. For example, a set of pin terminals 1A–1G are arranged side-by-side at a given pitch in an insert mold, and a molten material is poured into the insert mold and another insert mold to form the pin spacer G and the housing 2 simultaneously. As described earlier, pin spacer G can slide on the pin terminals of plug M when mating with receptacle N. The resistance or friction to the sliding of the pin spacer on the pin terminals of the plug can be varied by varying the thickness "t" of pin spacer G. Therefore, the resistance as required in a particular multi-pin connector can be met by controlling the thickness of the pin spacer. Alternatively, the resistance can be controlled by making a longitudinal slit 15 in the pin spacer along each pin terminal.

As may be understood from the above, in manufacturing such plugs, no extra complicated mold, such as that required for shaping prior perforated pin spacers, is required No assembly work is required, and hence no jig or stop for locating a pin spacer on the pin terminals of the plug at a desired level is necessitated. Accordingly, the manufacturing cost will be decreased.

FIG. 5 shows the complete insertion of all pin terminals 1A–1G of male plug M into corresponding pin holes of female receptacle N. As seen from this drawing, pin spacer G is pushed along the pin terminals of male plug M by a printed circuit board 9, which is positioned on a front wall 8 of female receptacle N. Finally, pin spacer G is sandwiched between front wall 4 of housing 2 of male plug M and the printed circuit board 9. In this example, the other ends 5 of pin terminals 1A–1G of male plug M are connected to selected conductors of a printed circuit on a printed circuit board 11, whereas the other ends 12 of the contact terminals of female receptacle N are connected to selected conductors of the printed circuit board 9. Thus, the multi-pin connector makes electrical connection between the conductors on two printed circuit boards 9 and 11.

Figure 6:
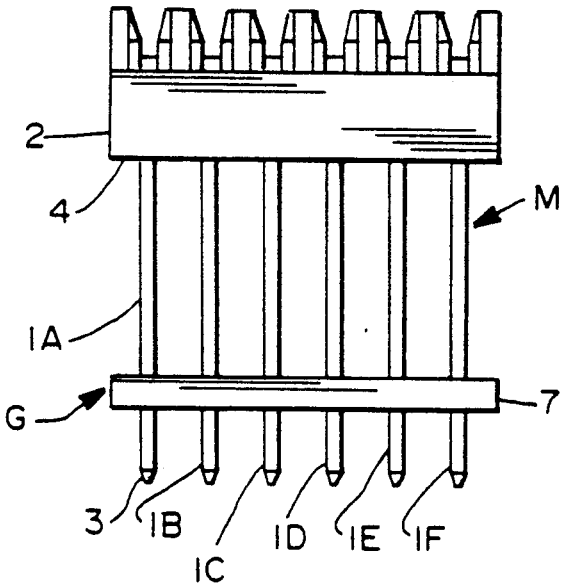
FIG. 6 is a front view of a male plug having a pin spacer on its pin terminals according to a second embodiment of the present invention.
Figure 7:
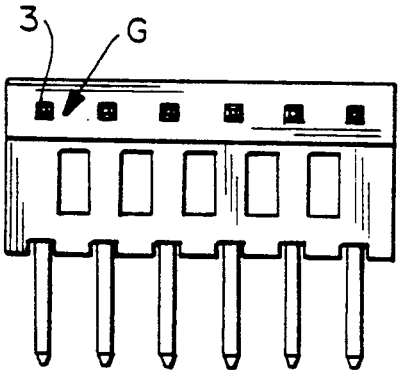
FIG. 7 is a plan view of the male plug and pin spacer assembly of FIG. 6.

FIGS. 6–8 show a multi-pin connector having an anti-bend pin spacer G slidably molded on its pin terminals according to a second embodiment of the invention. Like reference numerals and letters have been applied to FIGS. 6–8 corresponding to like elements described above in relation to the embodiment shown in FIGS. 1–5. This second embodiment is different from the multi-pin connector shown in FIGS. 1–5 in that it has bent pin terminals 1A–1F. These bent pin terminals are embedded in a housing 4 and a pin spacer G by insert molding.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An anti-bend pin spacer for use in a multi-pin connector assembly which includes a male plug having a plurality of pin terminals in a housing, and a surface having a plurality of pin holes for receiving said pin terminals, said housing being a molded part with said pin terminals fixedly embedded therein, characterized in that:

said pin spacer is a molded part with said pin terminals slidably embedded therein in the vicinity of free ends of the pin terminals, the part being molded about the pin terminals and simultaneously with molding the male plug housing.

2. An anti-bend pin spacer according to claim 1 wherein said pin terminals of the male plug are of a structure to be connected at their ends to selected conductors of a printed circuit, and wherein contact terminals of a female receptacle mate with said pin terminals and are of a structure to be connected at their ends to selected conductors of another printed circuit.

3. A multi-pin connector, comprising:

a male plug including a housing having a plurality of pin terminals for inserting into a plurality of complementary openings in a surface, the housing comprising a molded part fixedly embedding lengths of the pin terminals therein; and a pin spacer embracing the pin terminals in the vicinity of free ends thereof spaced from the plug housing, the pin spacer also comprising a part molded about the pin terminals and simultaneously molded with molding said housing and embedding the pin terminals therein with the pin spacer slidable along the pin terminals, whereby the free ends of the pin terminals can be inserted into the plurality of openings in the surface, and the surface can push the pin spacer slidably along the pin terminals towards the male plug and eventually sandwich the pin spacer between the plug housing and the surface.

4. The multi-pin connector of claim 3 wherein said pin spacer has slits located in juxtaposition with the pin terminals and extending longitudinally of the terminals.

5. A multi-pin connector, comprising:

a first connector including a housing having a plurality of pin terminals for inserting into a plurality of openings in a surface, the housing comprising a molded part fixedly embedding substantial lengths of the pin terminals therein; and a pin spacer embracing the pin terminals in the vicinity of free ends thereof spaced from the housing, the pin spacer also comprising a part molded about the pin terminals and simultaneously molded with molding said housing and embedding the pin terminals therein with the pin spacer slidable along the pin terminals, whereby the free ends of the pin terminals can be inserted into the plurality of openings in the surface, and the surface can push the pin spacer slidably along the pin terminals towards the first connector and eventually sandwich the pin spacer between the first connector and the surface.

6. The multi-pin connector of claim 5 wherein said pin spacer has slits located in juxtaposition with the pin terminals and extending longitudinally of the terminals.

7. An anti-bend pin spacer according to claim 1 wherein said pin spacer has a predetermined uniform thickness to define the contact area between the pin spacer and the terminals, whereby the force required to slide the pin spacer along the pin terminals is determined by the thickness of the pin spacer.

8. The multi-pin connector of claim 3 wherein said pin spacer has a predetermined uniform thickness to define the contact area between the pin spacer and the terminals, whereby the force required to slide the pin spacer along the pin terminals is determined by the thickness of the pin spacer.

9. The multi-pin connector of claim 5 wherein said pin spacer has a predetermined uniform thickness to define the contact area between the pin spacer and the terminals, whereby the force required to slide the pin spacer along the pin terminals is determined by the thickness of the pin spacer.

* * * * *